US008913931B2

(12) United States Patent
Hayashi et al.

(10) Patent No.: US 8,913,931 B2
(45) Date of Patent: Dec. 16, 2014

(54) DEVELOPING ROLL FOR ELECTROPHOTOGRAPHIC MACHINE

(71) Applicant: Tokai Rubber Industries, Ltd., Komaki (JP)

(72) Inventors: Yosuke Hayashi, Komaki (JP); Naoki Yamaguchi, Komaki (JP); Atsushi Ozaki, Komaki (JP); Kadai Takeyama, Komaki (JP)

(73) Assignee: Tokai Rubber Industries, Ltd., Komaki-shi (JP)

( * ) Notice: Subject to any disclaimer, the term of this patent is extended or adjusted under 35 U.S.C. 154(b) by 66 days.

(21) Appl. No.: 13/863,799

(22) Filed: Apr. 16, 2013

(65) Prior Publication Data

US 2013/0223893 A1 Aug. 29, 2013

Related U.S. Application Data

(63) Continuation of application No. PCT/JP2012/070349, filed on Aug. 9, 2012.

(30) Foreign Application Priority Data

Aug. 22, 2011 (JP) ..... 2011-180531
Jan. 30, 2012 (JP) ..... 2012-016321

(51) Int. Cl.
*G03G 15/08* (2006.01)

(52) U.S. Cl.
CPC ..... *G03G 15/0808* (2013.01); *G03G 15/0818* (2013.01)
USPC ..... 399/286

(58) Field of Classification Search
CPC ..... G03G 15/0808
USPC ..... 399/279, 286
See application file for complete search history.

(56) References Cited

U.S. PATENT DOCUMENTS 6,397,032 B1 * 5/2002 Sakaizawa et al. ..... 399/286
8,064,808 B2 * 11/2011 Anan et al. ..... 399/286

FOREIGN PATENT DOCUMENTS

JP 2005-120158 A 5/2005
JP 2008-058622 A 3/2008
JP 2010-237445 A 10/2010

OTHER PUBLICATIONS

International Search Report for PCT/JP2012/070349, mailing date of Sep. 4, 2012.

* cited by examiner

*Primary Examiner* — Sandra Brase
(74) *Attorney, Agent, or Firm* — Westerman, Hattori, Daniels & Adrian, LLP

(57) ABSTRACT

Provided is a developing roll for use in an electrophotographic machine capable of preventing an ion conductive agent from blooming and retaining long-term charge decay characteristics. The roll (1) includes a shaft (2), an elastomeric layer (3) and a surface layer (4), wherein the surface layer contains a composition containing an (A) ingredient defining a binder resin having a functional group reactive with an alkoxy silyl group in a (B) ingredient, and the (B) ingredient defining an ion conductive agent containing a cation having a chemical structure represented by $R1\text{-}N^{+}\text{-}R2\text{-}Si(OR3)_3$, where R1: a cyclic organic group or a linear organic group, R2: a group containing at least (CH2)n, n representing an integer number, and R3: an alkyl group, wherein the cation is bound with the (A) ingredient, and wherein the (B) ingredient is 0.10 to 3 parts by mass with respect to 100 parts by mass of the (A) ingredient.

4 Claims, 2 Drawing Sheets

DEVELOPING ROLL FOR ELECTROPHOTOGRAPHIC MACHINE

TECHNICAL FIELD

The present invention relates to a developing roll for use in an electrophotographic machine such as a copying machine, a printer, and a facsimile machine using a xerography.

BACKGROUND ART

Conventionally, electrophotographic copying machines using a contact charging method form images as follows. First, a surface of a photosensitive drum is uniformly charged by bringing a charging roll into contact with the photosensitive drum. Then, an original image is projected onto the surface of the photosensitive drum via an optical system. By discharging the charged electricity at the portion onto which the light is projected, an electrostatic latent image of the original image is formed thereon. Next, toner is uniformly applied to a developing roll. By coating the electrostatic latent image with the toner, a toner image is formed. Then, the toner image is transferred to transfer paper to form a transferred image.

The developing roll includes a shaft made from metal such as SUS, a conductive elastomeric layer (referred to also as a base layer) that surrounds the surface of the shaft, and a functional layer (referred to also as a surface layer) containing a binder resin, a conductive agent and other additives that surrounds the conductive elastomeric layer. The functional layer may be a single layer, or a multilayer.

The functional layer contains carbon black or an ion conductive agent as the conductive agent, with which a conductive property is provided to the functional layer. The functional layer is about 0.1 to 20 μm in thickness, and the binder resin thereof is made of a polyurethane resin, an acrylic resin or NBR. The elastomeric layer is about 1 to 4 mm in thickness, and is made of rubber such as silicone rubber, hydrin rubber and NBR.

If the content of the ion conductive agent is small in the functional layer of the developing roll, the charging fails to make differences in toner concentration at regular pitches, resulting in a problem of non-uniform image density. To be specific, as shown in FIG. 2, a printed image 110 includes higher-density portions 111 and lower-density portions 112, which alternately appear in a rotation direction of a developing roll 101. The concentration differences of the image density are so-called unevenness in a horizontal stripe pattern.

Meanwhile, if the content of the ion conductive agent is larger in the functional layer, the charging property of the functional layer is improved to prevent unevenness in a horizontals tripe pattern from developing. However, the larger ion conductive agent content causes problems that the toner sticks to the layer, that image unevenness and image contamination are increased by bloom of the ion conductive agent, and that a charged-electric quantity under an environment of high humidity is reduced.

A developing roll that is capable of solving the problem caused by the bloom of the ion conductive agent is known (e.g., PTL 1).

The developing roll of PTL 1 includes a surface layer that contains a binder resin, carbon black, an ion conductive agent, which is made of salt containing specific imidazolium cations and specific anions, and polyamide porous particles.

CITATION LIST

Patent Literature

PTL 1: Patent JP 2010-237445

SUMMARY OF INVENTION

Technical Problem

It is said that containing the carbon black, the specific ion conductive agent, and the polyamide porous particles agent, the developing roll of PTL 1 is capable of preventing the specific ion conductive agent from bleeding out thereon. However, the ion conductive agent is merely dispersed in the binder resin in the surface layer of the developing roll, and is not chemically bound with the binder resin. Thus, if the content of the ion conductive agent is increased, the ion conductive agent blooms, so that it is difficult for the developing roll to retain charge decay characteristics over a long period of time. In addition, the ion conductive agent is generally hydrophilic to be susceptible to the effect of water under an environment of high humidity. Thus, the developing roll has problems that its charge retention characteristics are decreased to decrease the charged-electric quantity.

The present invention is made in view of the problems described above, and an object of the present invention is to provide a developing roll for use in an electrophotographic machine, which is capable of preventing an ion conductive agent from blooming and capable of retaining charge decay characteristics over along period of time, and is insusceptible to the effect of water even under an environment of high humidity to be capable of retaining charge retention characteristics to obtain a sufficient charged-electric quantity.

Solution to Problem

To achieve the objects and in accordance with the purpose of the present invention, a developing roll for use in an electrophotographic machine of the present invention includes a shaft, an elastomeric layer that surrounds an outer periphery of the shaft, and a surface layer that surrounds an outer surface of the elastomeric layer, wherein the surface layer contains a composition that contains an (A) ingredient that defines a binder resin having a functional group that is reactive with an alkoxy silyl group contained in the following (B) ingredient, and a (B) ingredient that defines an ion conductive agent that contains a cation having a chemical structure represented by the following general formula (1), $$R1\text{-}N^{+}\text{—}R2\text{-}Si(OR3)_3 \quad (1),$$

where R1 is any one of a cyclic organic group, and a linear organic group, R2 is a group containing at least (CH2)n, wherein n represents an integer number, and R3 is an alkyl group, wherein the cation in the (B) ingredient is bound with the (A) ingredient, and wherein the content of the (B) ingredient is 0.10 to 3 parts by mass with respect to 100 parts by mass of the (A) ingredient.

It is preferable that the (B) ingredient contains an anion that defines bis(trifluoromethanesulfonyl)imide [(CF3SO2)2N-] (hereinafter, sometimes abbreviated as TFSI) in the developing roll.

It is preferable that the binder resin of the (A) ingredient defines any one of a polyurethane resin, and an acrylic resin in the developing roll.

Advantageous Effects of Invention

Because the ion conductive agent of the (B) ingredient that contains the cation having the specific chemical structure is reacted to be chemically bound with the binder resin of the (A) ingredient in the surface layer, the developing roll of the present invention is capable of preferably preventing the ion conductive agent from blooming on the surface layer, and capable of retaining charge decay characteristics over a long period of time compared with a conventional developing roll including a surface layer in which an ion conductive agent is merely dispersed in a binder resin. In addition, because the ion conductive agent is contained as sufficiently as needed in the surface layer, the developing roll of the present invention is capable of preventing unevenness in a horizontal stripe pattern from developing, whereby a uniform image can be obtained.

Further, when the anion ingredient in the ion conductive agent defines the TFSI, the ion conductive agent is hydrophobic. Thus, the developing roll of the present invention is insusceptible to the effect of water even under an environment of high humidity compared with a conventional developing roll containing a hydrophilic ion conductive agent, and is capable of retaining charge retention characteristics to obtain a sufficient charged-electric quantity. Thus, the developing roll of the present invention is capable of exerting its effect in a convincing way independently of the environment.

In addition, because the content of the ion conductive agent of the (B) ingredient is 0.10 to 3 parts by mass with respect to 100 parts by mass of the binder resin of the (A) ingredient, the developing roll of the present invention is capable of having a charging property over a long period of time in a convincing way. In addition, because there does not exist an excess of the ion conductive agent, which could not react with the binder resin to be left as residues, the developing roll of the present invention is free from a problem of blooming of an excess of the ion conductive agent on the surface layer, and a problem that an excess of the ion conductive agent reacts with toner and the toner sticks to the surface layer.

DESCRIPTION OF EMBODIMENTS

Figure 1:
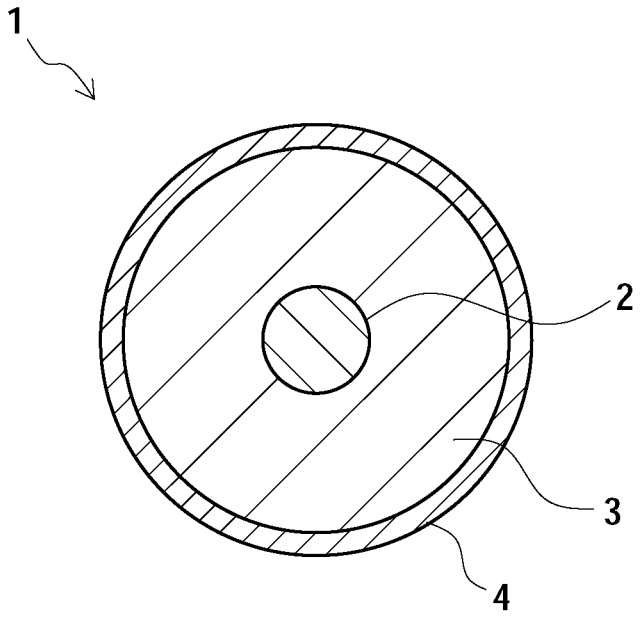
FIG. 1 is a cross-sectional view showing one example of a developing roll for use in an electrophotographic machine of the present invention.
Figure 2:
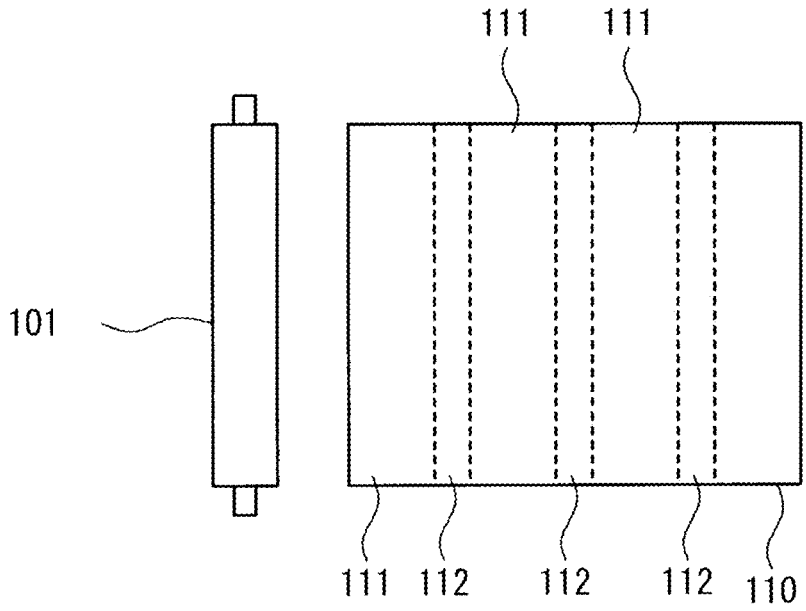
FIG. 2 PRIOR ART
FIG. 2 is an explanatory view for explaining problems of a conventional developing roll.

Hereinafter, a detailed description of preferred embodiments of a developing roll for use in an electrophotographic machine of the present invention will be provided. FIG. 1 is a cross-sectional view showing one example of the developing roll of the present invention. A developing roll 1 for use in an electrophotographic machine shown in FIG. 1 (hereinafter, sometimes referred to simply as the developing roll) includes a shaft 2, an elastomeric layer 3 that surrounds the outer periphery of the shaft 2, and a surface layer 4 that surrounds the outer surface of the elastomeric layer 3.

A core bar having a metallic solid body, or a metallic cylindrical body that is hollow inside is used for the shaft 2. The shaft 2 is made preferably of stainless, aluminum or iron, which is plated. In addition, the outer periphery of the shaft 2 is coated preferably with an adhesive agent or a primer as necessary.

The elastomeric layer 3 is made from a silicone rubber, an epichlorohydrin rubber, an acrylonitrilebutadiene rubber, a urethane rubber, a styrene-butadiene rubber, an isoprene rubber, or an ethylene-propylene-diene rubber. Among them, a single kind of rubber may be used alone, or two or more kinds of rubbers may be used in combination. In addition, a conductive agent such as carbon black may be contained in the elastomeric layer 3 as necessary.

The surface layer 4 is made from a composition that contains at least the following (A) ingredient and (B) ingredient. The following (B) ingredient defines an ion conductive agent that contains a cation, and the following (A) ingredient defines a binder resin. The ion conductive agent of the (B) ingredient reacts to be chemically bound with the binder resin of the (A) ingredient in the surface layer 4. Thus, because the surface layer 4 contains the composition containing the ion conductive agent that is reactive with the binder resin, the ion conductive agent reacts to be chemically bound with the binder resin. Thus, the ion conductive agent can be prevented from blooming on the surface layer 4.

Further, when an anion ingredient in the ion conductive agent used in the present invention defines TFSI, the ion conductive agent is hydrophobic to be insusceptible to the effect of water. Thus, the developing roll 1 is capable of preventing decrease in charged-electric quantity under an environment of high humidity, and is capable of lessening the dependence on the environment. The ingredients of the surface layer 4 are described below.

[(A) Ingredient]

The (A) ingredient defines a binder resin having a functional group that is reactive with an alkoxy silyl group contained in the following (B) ingredient. Specific examples of the binder resin include a polyurethane resin, and an acrylic resin. Examples of the functional group of these resins, which is reactive with the alkoxy silyl group, (hereinafter, sometimes referred to simply as the functional group) include a hydroxyl group, a carboxyl group, and an isocyanate group.

Examples of the polyurethane resin include a polyether polyurethane, a polyester polyurethane, a carbonate polyurethane, an acrylic polyurethane, and aliphatic polyurethane resins of various kinds. Among them, a single kind of polyurethane resin may be used alone, or two or more kinds of polyurethane resins may be used in combination. The polyurethane resin may have a urea bond or an imide bond in its molecular structure. The polyurethane resin is prepared by reaction of a known polyol with a known polyisocyanate.

Examples of the polyol ingredient in the polyurethane resin include a polyester polyol, a polyether polyol, a polycarbonate polyol, and an acrylic polyol. The polyol has a number average molecular mass (Mn) preferably within the range of 500 to 3000.

Examples of the polyester polyol include a diol ingredient such as a 1,4-butanediol, a 3-methyl-1,4-pentanediol and a neopentylglycol, a triol ingredient such as a trimethylolpropane, and a polyester polyol produced by condensation reaction of a dicarboxylic acid such as an adipic acid, an acid phthalic anhydride, a terephthalic acid and a hexahydroxy phthalic acid. Examples of the polyether polyol include a polyethylene glycol, a polypropylene glycol, and a polytetramethylene glycol. Prepolymers, which is chain-extended in advance by an isocyanate such as a 2,4-tolylene diisocyanate (TDI), a 1,4 diphenylmethane diisocyanate (MDI), and an isophorone diisocyanate (IPDI), may be used for these polyol ingredients.

The polyisocyanate ingredient in the polyurethane resin is not limited specifically; however, examples of the polyisocyanate ingredient include an aliphatic polyisocyanate such as a 1,6-hexamethylene diisocyanate (HDI), an alicyclic polyisocyanate such as an isophorone diisocyanate (IPDI), a cyclohexane 1,3-diisocyanate and a cyclohexane 1,4-diisocyanate, an aromatic isocyanate such as a 2,4-tolylene diisocyanate, a 2,6-tolylene diisocyanate (TDI) and a diphenylmethane diisocyanate (MDI), copolymers thereof, and block copolymers thereof.

The physical properties of a coat containing the polyurethane resin can be adjusted as appropriate by choosing the kinds and molecular masses of the polyisocyanate ingredient and the polyol ingredient. In order to introduce the functional group, which is reactive with the alkoxy silyl group contained in the ion conductive agent of the (B) ingredient, into the polyurethane resin, it is essential only that when the above-described ingredients are made to react with each other, a compound containing the functional group should be added thereto, whereby the polyurethane polymerization reaction should be made such that the functional group remains after the reaction. The functional group in the polyurethane resin may exist at the ends of the polymer molecules, or may exist at the midpoints of the polymer molecules.

In addition, the polyurethane resin may contain a chain extender, a catalyst, a foaming agent, a surface-active agent, a flame retardant agent, a coloring agent, a filler, a plasticizer, a stabilizer, and a mold-release agent as appropriate in addition to the polyisocyanate ingredient and the polyol ingredient.

The acrylic resin defines a polymer that is obtained by polymerizing an acrylic acid, a methacrylic acid, and esters thereof as main ingredients. The physical properties of a coat containing the acrylic resin can be adjusted as appropriate by the kinds of monomers, and monomers of the other resins to be copolymerized therewith, or the polymerization degree.

In order to introduce the functional group into the acrylic resin, it is essential only that monomers having the above-described functional group should be copolymerized such that the functional group remains in the resin after the copolymerization. The functional group in the acrylic resin may exist at the ends of the polymer molecules, or may exist at the midpoints of the polymer molecules.

The ratio (molar ratio) between the content of the above-described functional group in the binder resin and the content of the alkoxy silyl group in the ion conductive agent that is added thereto, that is, the functional group in the resin/the alkoxy silyl group, is preferably 1/1 or more.

[(B) Ingredient]

The (B) ingredient defines an ion conductive agent that contains a cation having a chemical structure represented by the following general formula (1):

$$R1\text{-}N^{+}\text{—}R2\text{-}Si(OR3)_3 \quad (1),$$

where

R1 is any one of a cyclic organic group, and a linear organic group,

R2 is a group containing at least (CH2)n, wherein n represents an integer number, and R3 is an alkyl group (e.g., —CH3, —C2H5).

It is essential only that the R1-N should be an ammonium compound. When R1 is the cyclic organic group, examples of the R1-N include a nitrogen-containing heterocyclic compound such as 5 membered ring such as pyrrole, pyrrolidine and imidazole, 6 membered ring such as pyridine and pyrimidine, indole, quinoline, isoquinoline, and a condensed ring of a pyrimidine ring and an imidazole ring such as purine. The compound may contain oxygen and sulfur in addition to the nitrogen in its ring structure.

It is also preferable that the R1-Nn is not a ring structure but an aliphatic hydrocarbon group having one to eighteen carbon atoms (including also an unsaturated bond). Specific examples thereof include a quaternary ammonium salt represented by the following general formula (2).

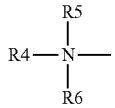

(2)

wherein R4 is an aliphatic hydrocarbon group having one to eighteen carbon atoms (e.g., —C8H17), and R5 and R6 are alkyl groups having one to four carbon atoms.

R2 in the general formula (1) is the group containing at least the methylene group (CH2)n. The number of the methylene group is preferably within the range of 1 to 18. In addition, the above-described R2 may contain a functional group such as an ester group, an amide group, an amino group, a thioether group, a hydroxyl group, a urethane group, an ether group, and an aromatic ring in addition to the methylene group.

Salt containing the cations, which contain the above-described ammonium compound, and anions is used as the ion conductive agent of the (B) ingredient. Not specifically limited, the above-described anions are preferably bis(trifluoromethanesulfonyl)imide anions [(CF3SO2)2N—] (TFSI). When the TFSI is used as the anions, the ion conductive agent has an advantage of being capable of obtaining a sufficient charged-electric quantity for toner under an environment of high temperature and humidity. Examples of the anions other than the TFSI include halogen ions such as CI—, and CI04-.

Structures (1) to (7), and structures (10) to (18) are shown in Tables 1 and 2, respectively, which are specific combination examples of the cations and the anions of the ion conductive agents.

The ion conductive agents having above-described structures (1) to (7) and structures (10) to (18) can be synthesized by known methods. Hereinafter, examples of the synthesis of these ion conductive agents will be provided.

[Synthesis of Ion Conductive Agents having Structures (1) and (4)]

60 mmol of 3-methylpyridine and 55 mmol of 3-chloropropyltrimethoxysilane were mixed under N2 atmosphere, and made to react at 90 degrees C. for 72 hours. After cleaning a solid object, which has been cooled to be precipitated out of the mixture, with ethyl acetate two times, the ethyl acetate was removed therefrom by reducing pressure to produce 53 mmol of a 3-methyl-1-trimethoxysilyl propyl pyridinium chloride [structure (4)] compound. Then, the produced compound was dissolved by acetone, and 53 mmol of bis (trifluoromethanesulfonyl)imide acid lithium salt was added thereto. The mixture was stirred at room temperature for 24 hours. Then, the solvent was removed therefrom by reducing pressure, and lithium chloride precipitated therefrom was filtered to produce 40 mmol of a 3-methyl-1-trimethoxysilyl propyl pyridinium bis (trifluoromethanesulfonyl)imide [structure (1)] compound.

[Synthesis of Ion Conductive Agents having Structures (2) and (3)]

Compounds of structures (2) and (3) were synthesized in a same manner as the above-described synthesis of the compound of structure (1) while the 3-methylpyridine was replaced with 1-methylpiperidine or 4-methylmorpholine.

[Synthesis of Ion Conductive Agent having Structure (5)]

60 mmol of (2-hydroxyethyl)trimethylammonium chloride and 59 mmol of 3-isocyanatopropyltriethoxysilane were mixed under N2 atmosphere, and made to react at 75 degrees C. for 48 hours. After cleaning a solid object, which has been cooled to be precipitated out of the mixture, with ethyl acetate two times, the ethyl acetate was removed therefrom by reducing pressure to produce 55 mmol of a compound for structure (5), where the anions defined chloride. Then, the produced compound was dissolved by acetone, and 55 mmol of bis (trifluoromethanesulfonyl)imide acid lithium salt was added thereto. The mixture was stirred at room temperature for 24 hours. Then, the solvent was removed therefrom by reducing pressure, and lithium chloride precipitated therefrom was filtered to produce 45 mmol of compound of structure (5).

[Synthesis of Ion Conductive Agent having Structure (6)]

60 mmol of [2-(acryloyloxy)ethyl]trimethylammonium chloride and 59 mmol of (3-aminopropyl) trimethoxysilane were mixed under N2 atmosphere, and made to react at 100 degrees C. for 72 hours. After cleaning a solid object, which has been cooled to be precipitated out of the mixture, with ethyl acetate two times, the ethyl acetate was removed therefrom by reducing pressure to produce 53 mmol of a compound for structure (6), where the anions defined chloride. Then, the produced compound was dissolved by acetone, and 53 mmol of bis (trifluoromethanesulfonyl)imide acid lithium salt was added thereto. The mixture was stirred at room temperature for 24 hours. Then, the solvent was removed therefrom by reducing pressure, and lithium chloride precipitated therefrom was filtered to produce 42 mmol of compound of structure (6).

[Synthesis of Ion Conductive Agent having Structure (7)]

A compound of structure (7) was synthesized in a same manner as the above-described synthesis of the compound of structure (6) while the (3-aminopropyl) trimethoxysilane was replaced with (3-mercaptopropyl) trimethoxysilane.

[Synthesis of Ion Conductive Agent having Structure (10)]

A compound of structure (10) was synthesized in a same manner as the above-described synthesis of the compound of structure (5) while the (2-hydroxyethyl) trimethylammonium chloride was replaced with (2-hydroxyethyl)triethylammonium iodide.

[Synthesis of Ion Conductive Agent having Structure (11)]

70 mmol of 2-(dibutylamino) ethanol, 75 mmol of 1-chlorobutane, and 50 g of ethanol were mixed under N2 atmosphere, and made to react at 80 degrees C. for 8 hours under reflux condition. The ethanol and extra 1-chlorobutane were distilled away therefrom by reducing pressure to produce 70 mmol of (2-hydroxyethyl)tributylammonium chloride.

A compound of structure (11) was synthesized in a same manner as the above-described synthesis of the compound of structure (5) while the (2-hydroxyethyl) trimethylammonium chloride was replaced with the produced (2-hydroxyethyl) tributylammonium chloride.

[Synthesis of Ion Conductive Agent having Structure (12)]

A compound of structure (12) was synthesized in a same manner as the above-described synthesis of the compound of structure (5) while the bis (trifluoromethanesulfonyl)imide acid lithium salt was replaced with bis(fluorosulfonyl)imide acid lithium salt.

[Synthesis of Ion Conductive Agent having Structure (13)]

A compound of structure (13) was synthesized in a same manner as the above-described synthesis of the compound of structure (5) while the bis (trifluoromethanesulfonyl)imide acid lithium salt was replaced with lithium hexafluorophosphate.

[Synthesis of Ion Conductive Agent having Structure (14)]

A compound of structure (14) was synthesized in a same manner as the above-described synthesis of the compound of structure (5) while the bis (trifluoromethanesulfonyl)imide acid lithium salt was replaced with lithium perchlorate.

[Synthesis of Ion Conductive Agent having Structure (15)]

A compound of structure (15) was synthesized in a same manner as the above-described synthesis of the compound of structure (5) while the bis (trifluoromethanesulfonyl)imide acid lithium salt was replaced with lithiumtetrafluoroborate.

[Synthesis of Ion Conductive Agent having Structure (16)]

A compound of structure (16) was synthesized in a same manner as the above-described synthesis of the compound of structure (5) while the bis (trifluoromethanesulfonyl)imide acid lithium salt was replaced with potassium trifluormethane sulphonate.

[Synthesis of Ion Conductive Agent having Structure (17)]

A compound of structure (17) was synthesized in a same manner as the above-described synthesis of the compound of structure (5) while the bis (trifluoromethanesulfonyl)imide acid lithium salt was replaced with potassium pentafluoroethane sulfonate.

[Synthesis of Ion Conductive Agent having Structure (18)]

A compound of structure (18) was synthesized in a same manner as the above-described synthesis of the compound of structure (5) while the bis (trifluoromethanesulfonyl)imide acid lithium salt was replaced with potassium nonafluorobutane sulfonate.

For the purpose of reference, ion conductive agents having structures (8) and (9) are shown in Table 3, which were used as Comparative Examples for the present invention. Synthesis processes of the ion conductive agents having structures (8) and (9) will be described below.

[Synthesis of Ion Conductive Agent having Structure (8)]

60 mmol of octyltrimethylammonium chloride was dissolved with ethyl acetate, and 60 mmol of lithium perchlorate was added thereto. The mixture was stirred at room temperature for 24 hours. Water was added to the mixture, and cleaning and extraction operation was carried out two times to separate the ethyl acetate layer from the mixture. The ethyl acetate was removed there from by reducing pressure to produce 51 mmol of compound of structure (8).

[Synthesis of Ion Conductive Agent having Structure (9)]

A compound of structure (9) was synthesized in a same manner as the above-described synthesis of the compound of structure (8) while the lithium perchlorate was replaced with bis (trifluoromethanesulfonyl)imide acid lithium salt.

TABLE 1

| | Cation | Anion |
|---|---|---|
| Structure (1) | 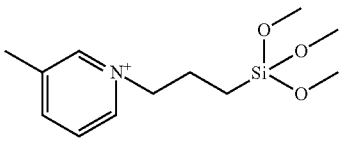 | 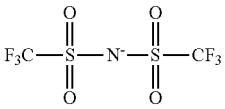 |

TABLE 1-continued
| | Cation | Anion |
|---|---|---|
| Structure (2) | 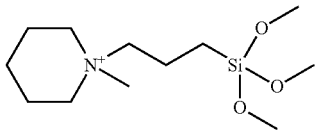 | 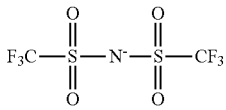 |
| Structure (3) | 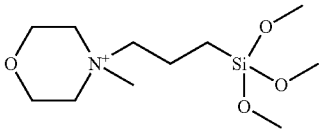 | 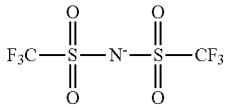 |
| Structure (4) | 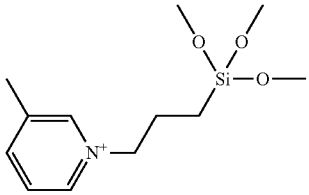 | $Cl^-$ |
| Structure (5) | 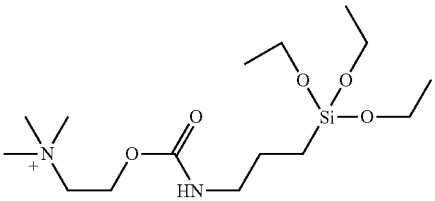 | 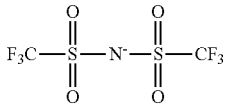 |
| Structure (6) | 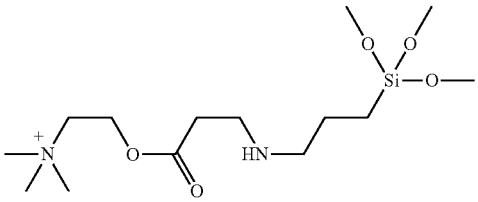 | 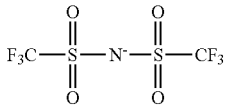 |
| Structure (7) | 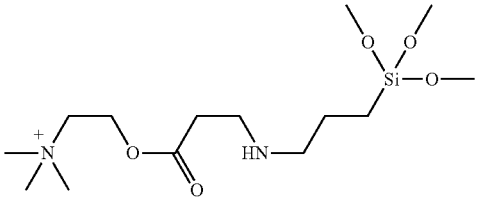 | 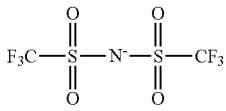 |
TABLE 2
| | Cation | Anion |
|---|---|---|
| Structure (10) | 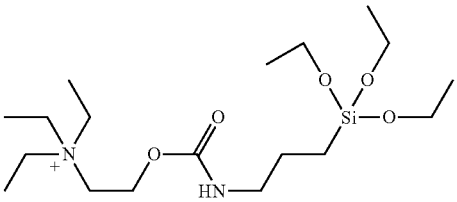 | 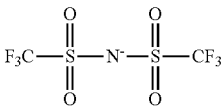 |

TABLE 2-continued
| | Cation | Anion |
|---|---|---|
| Structure (11) | 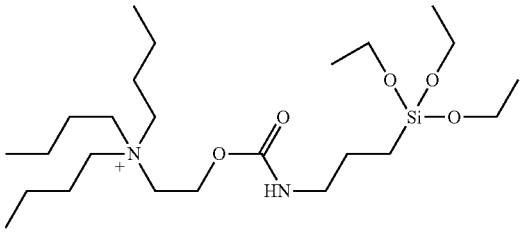 | 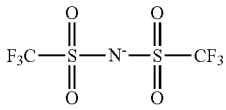 |
| Structure (12) | 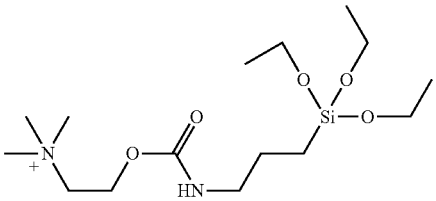 | 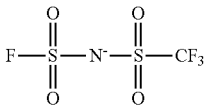 |
| Structure (13) | 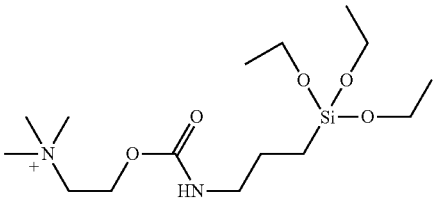 | $PF_6^-$ |
| Structure (14) | 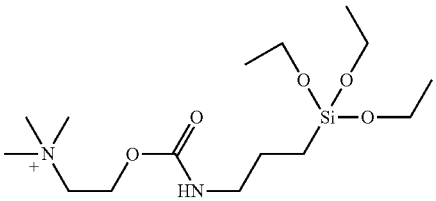 | $ClO_4^-$ |
| Structure (15) | 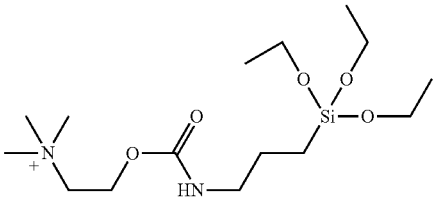 | $BF_4^-$ |
| Structure (16) | 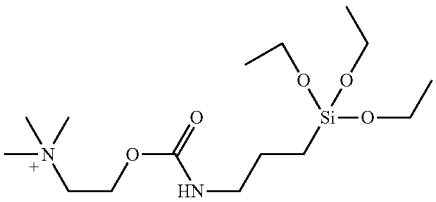 | 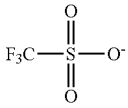 |
| Structure (17) | 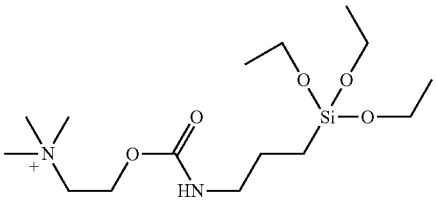 | 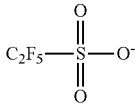 |

TABLE 2-continued

| | Cation | Anion |
|---|---|---|
| Structure (18) | 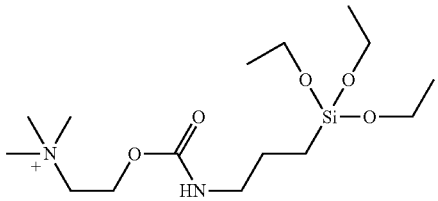 | 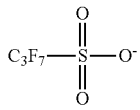 |

TABLE 3

| | Cation | Anion |
|---|---|---|
| Structure (8) | 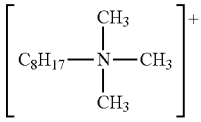 | $^{-}ClO_4$ |
| Structure (9) | 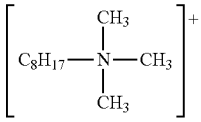 | 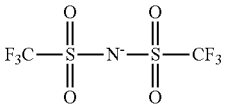 |

Because the alkoxy silyl group of the ion conductive agent of the (B) ingredient is reacted with the functional group of the binder resin of the (A) ingredient, the cations of the ion conductive agent of the (B) ingredient are bound with the functional group, and thus the ion conductive agent chemically bound with the binder resin. In general, it is essential only that both the ingredients should be mixed, heated as necessary, and reacted for a given period of time in order to bind the (B) ingredient with the binder resin of the (A) ingredient.

For example, when the polyurethane resin is used as the binder resin, the (B) ingredient is added to be reacted with the binder resin of the (A) ingredient in mixing and reacting the polyisocyanate ingredient with the polyol ingredient, whereby reaction of a hydroxyl group of the isocyanate ingredient with a hydroxyl group of the polyol ingredient can be produced concurrently with reaction of a hydroxyl group of the polyol ingredient and the alkoxy silyl group.

The content of the (B) ingredient is 0.10 to 3 parts by mass with respect to 100 parts by mass of the (A) ingredient. If the (B) ingredient content is less than 0.10 parts by mass with respect to 100 parts by mass of the (A) ingredient, the content of the ion conductive agent is too small to cause unevenness in a horizontal stripe pattern in an image, so that a uniform image cannot be obtained. On the other hand, if the (B) ingredient content is more than 3 parts by mass with respect to 100 parts by mass of the (A) ingredient, the (B) ingredient content is too large to increase the unreacted ion conductive agent. The increased ion conductive agent that is unreacted with the binder resin causes problems that toner sticks to the surface layer, that image unevenness appears by bloom of the ion conductive agent, and that a charged-electric quantity under an environment of high humidity is reduced.

It is preferable that the surface layer 4 further contains other additives than the (A) ingredient and the (B) ingredient as appropriate within a range of not impairing the purpose of the present invention. Examples of the other additives include an electronically conductive agent such as carbon black, carbon nanotube and metallic oxide, paint additives of various kinds mainly made from silicon or fluorine, a dispersing agent, an antiaging agent, an antioxidant, a coupling agent, a curing catalyst, and organic/inorganic particles for providing surface roughness. Among them, a single kind of additive may be used alone, or two or more kinds of additives may be used in combination.

Hereinafter, a description of one example of a method for producing the above-described developing roll 1 will be provided. The composition of the surface layer 4 consisting of the above-described (A) ingredient, (B) ingredient and the other additives is dissolved and stirred in an organic solvent in advance to prepare a coating liquid for the surface layer 4 so as to have appropriate viscosity. In addition, the ingredients from which the elastomeric layer 3 is made are kneaded in advance with the use of a kneading machine such as a kneader. First, an injection molding die, in which a core bar that defines the shaft 2 preferably made of conductive metal is placed, is filled with the ingredients for the elastomeric layer 3, and the ingredients are thermal crosslinked under given conditions and removed from the die. Thus, a base roll, which includes the shaft 2 and the elastomeric layer 3 that surrounds the outer periphery of the shaft 2, is produced. Then, the coating liquid for the surface layer 4 is coated on the outer periphery of the base roll to produce the surface layer 4. Thus, the developing roll 1, which includes the elastomeric layer 3 and the surface layer 4 that surrounds the outer surface of the elastomeric layer 3, is produced.

The elastomeric layer 3 may be formed not only in the injection molding method but also in a cast molding method or in a method for polishing after press molding. In addition, the surface layer 4 is coated in a dipping method, a spray coating method, a roll coating method, or a brush painting method. Examples of the above-described organic solvent include methyl ethyl ketone, toluene, acetone, diethyl ether, ethyl acetate, butyl acetate, methyl isobutyl ketone, tetrahydrofuran, m-cresol, and N-methyl-2-pyrolidone. Among them, a single kind of organic solvent may be used alone, or two or more kinds of organic solvents may be used in combination.

While the developing roll of the preferred embodiment shown in FIG. 1 includes the surface layer 4 of a single layer, it is also preferable that the developing roll of the present invention includes the surface layer 4 of a multilayer of two or more layers. While the developing roll of the preferred embodiment shown in FIG. 1 includes the elastomeric layer 3 of a single layer, it is also preferable that the developing roll of the present invention includes the elastomeric layer 3 of a multilayer of two or more layers.

EXAMPLE

A description of the present invention will now be specifically provided with reference to Examples and Comparative Examples. However, the present invention is not limited thereto.

First, the following ingredients were prepared to be produced before preparing developing rolls of Examples and Comparative Examples.

[Shaft]

Core bar (8 mm in diameter, manufactured by SUS CORPORATION)

[Elastomeric Layer]

Conductive silicone rubber (manufactured by SHIN-ETSU CHEMICAL CO., LTD., product name: "X34-264A/B")

[Surface Layer]

(A) Binder Resin

Polyol (manufactured by NIPPON POLYURETHANE INDUSTRY CO., LTD., product name: "NIPPOLAN 5196"), 100 parts by mass Isocyanate (manufactured by NIPPON POLYURETHANE INDUSTRY CO., LTD., product name: "CORONATE HL"), 30 parts by mass Carbon black (manufactured by DENKI KAGAKU KOGYO KABUSHIKI KAISHA, product name: "DENKA BLACK HS-100"), 30 parts by mass (B) Ion Conductive Agent Salts containing cations and anions having structures (1) to (18) shown in above-described Tables 1 to 3

Developing rolls of Examples and Comparative examples were prepared as follows.

[Preparation of Developing Rolls]

A molding die, in which the core bar that defined the shaft was placed, was filled with the ingredient for elastomeric layer, and the ingredient was heated under the conditions of 140 degrees C. for 30 minutes and removed from the die. In this manner, elastomeric layers (4 mm in thickness) that surrounded the outer peripheries of the shafts were produced. Next, the compositions, which contain the (A) binder resins (i.e., the polyurethane resins containing the polyol, the isocyanate and the carbon black) and the (B) ion conductive agents shown in Tables 4 to 11, where the contents (parts by mass) of the (B) ion conductive agents are as shown in Tables 4 to 11 with respect to 100 parts by mass of the (A) binder resins, were coated on the outer peripheries of the above-described elastomeric layers to be dried, and surface layers (15 μm in thickness) were produced. Thus, the developing rolls of the Examples and the Comparative Examples were produced.

Evaluations of thus-produced developing rolls were made in terms of the following properties in accordance with the following standards. Results thereof are shown together in Tables 4 to 11.

[Sticking Property]

The entire surface of each developing roll was coated with toner, and each developing roll was incorporated in an evaluation cartridge to be left under an environment of 40 degrees C./95% RH for 30 days. Then, printing operations with the use of an actual machine were made. The obtained images were checked. The images that are clean without a problem were regarded as excellent. The images that have horizontal streaks in a cycle of the developing rolls were regarded as failed.

[Unevenness in a Horizontal Stripe Pattern after Endurance]

Each developing roll was incorporated in an evaluation cartridge to be left under an environment of low temperature and humidity (15 degrees, 10% in humidity) for 12 hours or more. Then, printing operations of 10000 sheets of 5% printed image with the use of an actual machine under this environment were made to see the endurance of each developing roll. The images that are clean without density irregularity after the endurance were regarded as excellent. The images that have horizontal irregularity in a cycle of the developing rolls were regarded as failed.

[H/H Charged-Electric Quantity]

Each developing roll was incorporated in an evaluation cartridge to be left under an environment of high temperature and humidity (32.5 degrees, 85% in humidity) for 12 hours or more. Then, a printing operation of one sheet of solid printed image with the use of an actual machine under this environment was made, and the electrical charge amount and weight of the toner on each developing roll at this time was measured by a suction method. The images of which values of electrical charge amount/weight (Q/M) at the time were −25 μC/g or more were regarded as excellent. The images of which values of electrical charge amount/weight (Q/M) at the time were −20 to 25 μC/g were regarded as unfavorable. The images of which values of electrical charge amount/weight (Q/M) at the time were less than −20 μC/g were regarded as failed.

TABLE 4

| | Example | | | | Comparative Example |
|---|---|---|---|---|---|
| | 1-1 | 1-2 | 1-3 | 1-4 | 1-1 |
| Ion conductive agent (parts by mass) | | | | | |
| Structure (1) | 0.1 | 0.2 | 1 | 3 | 5 |
| Properties of developing roll | | | | | |
| Sticking property | Excellent | Excellent | Excellent | Excellent | Failed |
| Unevenness in a horizontal stripe pattern after endurance | Excellent | Excellent | Excellent | Excellent | Excellent |
| H/H charged-electric quantity | Excellent | Excellent | Excellent | Excellent | Failed |

TABLE 5

| | Example | | | | Comparative Example |
|---|---|---|---|---|---|
| | 2-1 | 2-2 | 2-3 | 2-4 | 2-1 |
| Ion conductive agent (parts by mass) | | | | | |
| Structure (2) | 0.1 | 0.2 | 1 | 3 | 5 |
| Properties of developing roll | | | | | |
| Sticking property | Excellent | Excellent | Excellent | Excellent | Failed |
| Unevenness in a horizontal stripe pattern after endurance | Excellent | Excellent | Excellent | Excellent | Excellent |
| H/H charged-electric quantity | Excellent | Excellent | Excellent | Excellent | Failed |

TABLE 6

| | Example | | | | Comparative Example |
|---|---|---|---|---|---|
| | 3-1 | 3-2 | 3-3 | 3-4 | 3-1 |
| Ion conductive agent (parts by mass) | | | | | |
| Structure (3) | 0.1 | 0.2 | 1 | 3 | 5 |
| Properties of developing roll | | | | | |
| Sticking property | Excellent | Excellent | Excellent | Excellent | Failed |
| Unevenness in a horizontal stripe pattern after endurance | Excellent | Excellent | Excellent | Excellent | Excellent |
| H/H charged-electric quantity | Excellent | Excellent | Excellent | Excellent | Failed |

TABLE 7

| | Example | | | | Comparative Example |
|---|---|---|---|---|---|
| | 4-1 | 4-2 | 4-3 | 4-4 | 4-1 |
| Ion conductive agent (parts by mass) | | | | | |
| Structure (4) | 0.1 | 0.2 | 1 | 3 | 5 |
| Properties of developing roll | | | | | |
| Sticking property | Excellent | Excellent | Excellent | Excellent | Failed |
| Unevenness in a horizontal stripe pattern after endurance | Excellent | Excellent | Excellent | Excellent | Excellent |
| H/H charged-electric quantity | Excellent | Failed | Failed | Failed | Failed |

TABLE 8

| | Example | | |
|---|---|---|---|
| | 5-1 | 6-1 | 7-1 |
| Ion conductive agent (parts by mass) | | | |
| Structure (5) | 1 | | |
| Structure (6) | | 1 | |
| Structure (7) | | | 1 |

TABLE 8-continued

| | Example | | |
|---|---|---|---|
| | 5-1 | 6-1 | 7-1 |
| Properties of developing roll | | | |
| Sticking property | Excellent | Excellent | Excellent |
| Unevenness in a horizontal stripe pattern after endurance | Excellent | Excellent | Excellent |
| H/H charged-electric quantity | Excellent | Excellent | Excellent |

TABLE 9

| | Comparative Example | | | | |
|---|---|---|---|---|---|
| | 8-1 | 8-2 | 8-3 | 8-4 | 8-5 |
| Ion conductive agent (parts by mass) | | | | | |
| Structure (8) | 0.1 | 0.2 | 1 | 3 | 5 |
| Properties of developing roll | | | | | |
| Sticking property | Excellent | Excellent | Failed | Failed | Failed |
| Unevenness in a horizontal stripe pattern after endurance | Failed | Failed | Excellent | Excellent | Excellent |
| H/H charged-electric quantity | Excellent | Failed | Failed | Failed | Failed |

TABLE 10

| | Comparative Example | | | | |
|---|---|---|---|---|---|
| | 9-1 | 9-2 | 9-3 | 9-4 | 9-5 |
| Ion conductive agent (parts by mass) | | | | | |
| Structure (9) | 0.1 | 0.2 | 1 | 3 | 5 |
| Properties of developing roll | | | | | |
| Sticking property | Excellent | Excellent | Failed | Failed | Failed |
| Unevenness in a horizontal stripe pattern after endurance | Failed | Failed | Excellent | Excellent | Excellent |
| H/H charged-electric quantity | Excellent | Unfavorable | Failed | Failed | Failed |

TABLE 11

| | Example | | | | | | | | |
|---|---|---|---|---|---|---|---|---|---|
| | 10-1 | 11-1 | 12-1 | 13-1 | 14-1 | 15-1 | 16-1 | 17-1 | 18-1 |
| Ion conductive agent (parts by mass) | | | | | | | | | |
| Structure (10) | 1 | | | | | | | | |
| Structure (11) | | 1 | | | | | | | |
| Structure (12) | | | 1 | | | | | | |
| Structure (13) | | | | 1 | | | | | |
| Structure (14) | | | | | 1 | | | | |
| Structure (15) | | | | | | 1 | | | |
| Structure (16) | | | | | | | 1 | | |
| Structure (17) | | | | | | | | 1 | |
| Structure (18) | | | | | | | | | 1 |
| Properties of developing roll | | | | | | | | | |
| Sticking property | Excellent | Excellent | Excellent | Excellent | Excellent | Excellent | Excellent | Excellent | Excellent |
| Unevenness in a horizontal stripe pattern after endurance | Excellent | Excellent | Excellent | Excellent | Excellent | Excellent | Excellent | Excellent | Excellent |
| H/H charged-electric quantity | Excellent | Excellent | Excellent | Excellent | Excellent | Excellent | Excellent | Excellent | Excellent |

As evident from the results shown in Tables 4 to 8, and 11, the developing rolls of the Examples were all excellent both in sticking property, and unevenness in a horizontal stripe pattern after endurance. Meanwhile, the developing rolls of Comparative Examples 1-1, 2-1, 3-1, 4-1 had the unsatisfactory results in sticking property, and H/H charged-electric quantity because the contents of the ion conductive agents were over the range of the present invention while the ion conductive agents same as the Examples were used.

In addition, as shown in Table 9, the developing rolls of Comparative Examples 8-1 to 8-5 contained the ion conductive agents of which the cations were not reactive with the binder resins, so that when the contents of the ion conductive agents were small, the developing rolls (Comparative Examples 8-1, 8-2) were unfavorable in unevenness in a horizontal stripe pattern after endurance. Meanwhile, when the contents of the ion conductive agents were large, the developing rolls (Comparative Examples 8-3, 8-4, 8-5) were unfavorable in sticking property. Thus, the developing rolls of Comparative Examples 8-1 to 8-5 could not satisfy both the properties.

In addition, as shown in Table 9, the developing rolls of Comparative Examples 8-2 to 8-5 were unfavorable in H/H charged-electric quantity when the contents of the ion conductive agents were small. This is because the ion conductive agents of which the cations were not fixed were apt to have relatively high conductivity. Thus, it is assumed that the small contents of the ion conductive agents decrease surface resistance of the developing rolls to make it difficult for the developing rolls to friction charge, whereby the charged-electric quantity of toner was decreased In addition, as shown in Table 10, the developing rolls of Comparative Examples 9-1 to 9-5 contained the TFSI as the anions in the ion conductive agents. However, the cations in the ion conductive agents were not reactive with the binder resins similarly to the developing rolls of Comparative Examples 8-1 to 8-5 shown in Table 9. Thus, the developing rolls of Comparative Examples 9-1 to 9-5 could not satisfy the sticking property and the property of unevenness in a horizontal stripe pattern, and were unfavorable also in H/H charged-electric quantity similarly to the results shown in Table 9.

In addition, as shown in Table 7, the developing rolls of Examples 4-1 to 4-4 contained chlorine ions (Cl—) as the anions in the ion conductive agents, and the cations that were reactive with the binder resins same as the cations of Examples 1-1 to 1-4. In this case, when the contents of the ion conductive agents were within the range of 0.2 to 3 parts by mass, the developing rolls of Examples 4-1 to 4-4 were favorable in sticking property and property of unevenness in a horizontal stripe pattern. However, when the contents of the ion conductive agents were 0.2 parts by mass or more, the developing rolls were unfavorable in H/H charged-electric quantity. Meanwhile, the developing rolls of Examples 1-1 to 1-4 shown in Table 4, which contained the TFSI as the anions in the ion conductive agents while contained the cations same as Examples 4-1 to 4-4, were favorable in H/H charged-electric quantity when the contents of the ion conductive agents were within the range of 0.2 to 3 parts by mass. This means that the property of H/H charged-electric quantity was improved when the developing rolls contained the TFSI as the anions in the ion conductive agents.

The invention claimed is:

1. A developing roll for use in an electrophotographic machine, the roll comprising:

a shaft;

an elastomeric layer that surrounds an outer periphery of the shaft; and a surface layer that surrounds an outer surface of the elastomeric layer, wherein the surface layer contains a composition that contains:

an (A) ingredient that comprises a binder resin having a functional group that is reactive with an alkoxy silyl group contained in the following (B) ingredient; and a (B) ingredient that comprises an ion conductive agent that contains a cation having a chemical structure represented by the following general formula (1):

$$R1\text{-}N^{+}\text{—}R2\text{-}Si(OR3)_3 \quad (1),$$

where:

R1 is any one of a cyclic organic group, and a linear organic group;

R2 is a group containing at least (CH2)n, wherein n represents an integer number; and R3 is an alkyl group, wherein the cation in the (B) ingredient is bound with the (A) ingredient, and wherein the content of the (B) ingredient is 0.10 to 3 parts by mass with respect to 100 parts by mass of the (A) ingredient.

2. The developing roll according to claim 1, wherein the (B) ingredient contains an anion that comprises bis(trifluoromethanesulfonyl)imide.

3. The developing roll according to claim 2, wherein the binder resin of the (A) ingredient comprises any one of a polyurethane resin, and an acrylic resin.

4. The developing roll according to claim 1, wherein the binder resin of the (A) ingredient comprises any one of a polyurethane resin, and an acrylic resin.

* * * * *

UNITED STATES PATENT AND TRADEMARK OFFICE

CERTIFICATE OF CORRECTION

PATENT NO. : 8,913,931 B2
APPLICATION NO. : 13/863799
DATED : December 16, 2014
INVENTOR(S) : Yosuke Hayashi et al.

It is certified that error appears in the above-identified patent and that said Letters Patent is hereby corrected as shown below:

ON THE TITLE PAGE

At item (73), Assignee, change:

"(73) Assignee: TOKAI RUBBER INDUSTRIES LTD., Komaki-shi (JP)"

to

--(73) Assignee: SUMITOMO RIKO COMPANY LIMITED, Aichi (JP)--

Signed and Sealed this
Twenty-second Day of December, 2015

Michelle K. Lee

Michelle K. Lee
*Director of the United States Patent and Trademark Office*